United States Patent [19]

Jungwirth

[11] Patent Number: 4,809,379

[45] Date of Patent: Mar. 7, 1989

[54] PROCESS FOR THE MANUFACTURE OF AN INNER SHOE FOR SKIING BOOTS

[75] Inventor: Eduard R. Jungwirth, Ried im Innkreis, Austria

[73] Assignee: Skischuhfabrik Dynafit Gesellschaft m.b.H, Graz, Austria

[21] Appl. No.: 57,526

[22] PCT Filed: Feb. 13, 1986

[86] PCT No.: PCT/AT86/00013

§ 371 Date: Jul. 6, 1987

§ 102(e) Date: Jul. 6, 1987

[87] PCT Pub. No.: WO87/01566

PCT Pub. Date: Mar. 16, 1987

[30] Foreign Application Priority Data

Sep. 17, 1985 [AT] Austria ..... 2710/85

[51] Int. Cl.[4] ..... A43B 7/14

[52] U.S. Cl. ..... 12/142 R; 36/93

[58] Field of Search ..... 12/142 R; 36/88, 93, 36/117, 119; 264/222, 223

[56] References Cited

U.S. PATENT DOCUMENTS

| | | | |
|---|---|---|---|
| 3,736,612 | 6/1973 | Check et al. | 12/142 P |
| 3,744,161 | 7/1973 | Herunter | 36/93 |
| 3,769,392 | 10/1973 | Tessaro | 264/45 |
| 3,786,580 | 1/1974 | Dalebout | 36/93 |
| 3,834,044 | 9/1977 | McAusland et al. | 36/93 |
| 3,896,202 | 7/1975 | Palau | 36/93 |
| 4,120,064 | 10/1978 | Salomon | 36/93 |
| 4,182,056 | 1/1980 | Dalebout | 36/117 |
| 4,651,444 | 3/1987 | Ours | 36/93 |

FOREIGN PATENT DOCUMENTS

| | | | |
|---|---|---|---|
| 7022047 | 2/1971 | Fed. Rep. of Germany . | |
| 2106667 | 4/1972 | Fed. Rep. of Germany | 36/93 |
| 2456754 | 6/1975 | Fed. Rep. of Germany | 36/93 |
| 3137700 | 9/1981 | Fed. Rep. of Germany . | |
| 2111147 | 2/1972 | France . | |
| 2541095 | 8/1984 | France . | |
| 308590 | 2/1969 | Netherlands . | |
| 317042 | 11/1973 | Netherlands . | |
| 333624 | 3/1976 | Netherlands . | |
| 364280 | 2/1981 | Netherlands . | |
| WO79/00886 | 11/1979 | World Int. Prop. O. . | |

*Primary Examiner*—Steven N. Meyers

*Attorney, Agent, or Firm*—Fleit, Jacobson, Cohn & Price

[57] ABSTRACT

In a process for the manufacture of an inner shoe for skiing boots by filling the inner shoe in situ with foam, the foot of the wearer is dressed with a double-walled sock (hollow sock) (14) and placed inside the skiing boot, whereafter the foam composition is introduced in the flexor region of the boot by way of tubes (10) into the cavity of the sock unitl it re-emerges above the locality of introduction and where appropriate also at the tip end of the cavity by way of tubes. (9 or 9').

5 Claims, 2 Drawing Sheets

PROCESS FOR THE MANUFACTURE OF AN INNER SHOE FOR SKIING BOOTS

BACKGROUND OF THE INVENTION

The invention relates to a process for the manufacture of an inner shoe for skiing boots by in situ filling the inner shoe with foam, whilst the foot of the wearer, clad with a double walled sock (hollow sock) is placed inside the shoe, the foam material being introduced into the hollow sock in the lower part of the boot and the air displaced thereby being released at the top end thereof.

A process of this nature has become known from U.S. Pat. No. 3,834,044. It offers the advantage that the boot is made to fit accurately the shape of the foot of the wearer. In this context a filling tube positioned in the longitudinal central plane of the boot conducts the foam into a cavity in the heel region from where the foam in the course of its reacting and curing is distributed onwards in an uncontrolled manner towards the front and upper parts of the boot. In the case of skiing boots the inner shoe generally extends above the ankle. The foam, in the course of reacting, first enters into a space of large volume, expands therein and only subsequently thereto the foam travels in an uncontrolled fashion into the upper and the tip region which has a much lesser volume. The air between the inner shoe lining and the outer layer is displaced due to the chemical reaction of the components and escapes to the atmosphere through a venting tube provided in the upper ankle region of the boot. Accordingly, the foam travels in the direction of least resistance. However, the air to be displaced is not discharged fully by way of the venting tube, but also remains trapped, particularly in the tip region, but also in part in the upper inner shoe region and forms air bubbles. The forward supply of not yet reacted foam is delayed by congestive effects. Since the reaction takes place within narrow limits it can happen, due to retardation of the throughflow velocity, that the front regions are not or only inadequately filled with foam. The maintenance of the components temperature in particular, which is one of the factors influencing the reaction period can only be maintained with very great difficult in condition as prevail in the trade. Apart from the aforementioned disadvantages it also happens quite frequently that excess foam enters on one side and may displace the foot in the lower region out of the axis of the skiing boot. The foot will then be displaced either obliquely or parallel to the boot axis and be set in the foam asymmetrically. This situation has an adverse effect when skiing. Finally, when foam is injected from behind, the foot is pushed forward by the reaction pressure onto the Achilles tendon and the heel region. This leads to the further drawback that a spacer toe-cap inserted for the maintenance of the required toe space will result in excessive pain in the toe region during the foaming procedure.

It is known from DE-OS No. 24 56 754 that the foam is introduced into the front region of the boot, however such that the foam is not conducted into a hollow sock, but into the cavity between a sock and the inner periphery of the outer boot. The drawback of this procedure is that at the upper end of the boot no opening is provided for the displaced air, a factor which can give rise to airlocks.

In accordance with DE-OS No. 21 06 667 two inlet appertures for the plastics material are provided above the heel region whilst a single outlet apperture is provided on the upper side of the boot tip. This manner of introducing the foam may result in an uneven distribution of the foam and in addition air-bubbles may form in the upper region of the boot because such bubbles tend to rise upwards and can then not escape through the outlet opening in its relatively low position.

OBJECTS AND BRIEF DESCRIPTION OF THE INVENTION

It is an object of the present invention to overcome the drawbacks of the known processes. In this context it is advantageous that the foam material enters the ankle region with comparatively high pressure, so that in this region, where the foot is subjected to the greatest lateral pressure loads, a compact adequate cushioning is created without the formation of dead spaces due to trapped air in the remaining foam-filled regions of the inner shoe. In order to attain this object it is proposed, in a process as set out in the introduction, that in accordance with the invention, the foam or respectively the composition employed for filling the boot with foam is introduced on both sides of the boot in the region between the ankle and the instep.

Due to these expedients the air escapes upwards without forming air-locks. The introduction of the foam in the region between the ankle and the instep provides the advantage that the composition which expands in the heel region where the largest quantity is required, will enter there directly and without detour and forms a compact mass.

Advantageously the foam or the composition is introduced to the right hand and left hand sides of the longitudinal plane of symmetry of the boot. This results in a uniform distribution of the foam.

Advantageously, the two cavities in the front region of the boot into which the foam or the composition is introduced are partitioned from one another. It is advantageous if the foam or the composition is introduced on both sides of the lower end o the entry opening of the boot or in the region of such opening. This results in a further improvement of the flow of the foam. In this context it is of particular advantage if the air escapes on both sides of the longitudinal plane of symmetry of the boot. This produces the effect that the reacting foam causes the air to be pushed forward uniformly on both sides of the boot and to be displaced outwards entirely.

By commencing the foam introduction from the front, the foam is first applied over the naturally narrowest regions and only subsequently thereto the foam is driven into the larger free space or the heel region respectively. The generation of congestions is avoided by the predetermined physically correct direction of flow and only due to this technology can the disadvantage of asymmetrical foam introduction by avoided. Due to the pre-programmed and simultaneous foam introduction into the instep and ball regions and alignment of the foot is maintained and the foot is not displaced axially.

Finally, due to the foam introduction from the front over the foot, no thrust is exercised in the skiing boot axis because the reacting foam slides over the lateral instep region towards the rear and does not encounter attach areas for such thrust. This results in a proper flow around the foot without the foot position being changed. An improved and uniform cushioning is attained by this measure.

BRIEF DESCRIPTION OF THE DRAWINGS

Further details of the invetive method will be explained with reference to the drawing in which.

DESCRIPTION OF SPECIFIC EMBODIMENTS

Figure 3:
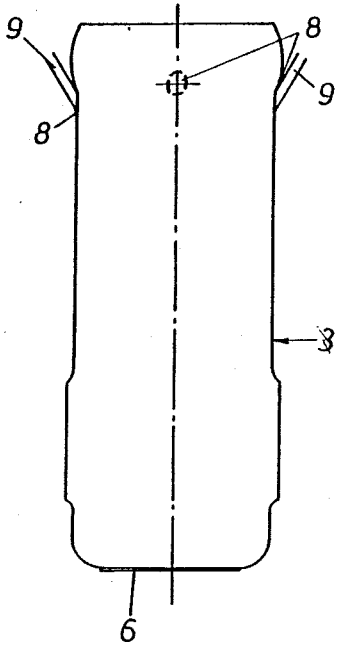
FIG. 3 shows the back view of the inner shoe and FIG. 4 shows a further embodiment according to FIG. 1.
Figure 2:
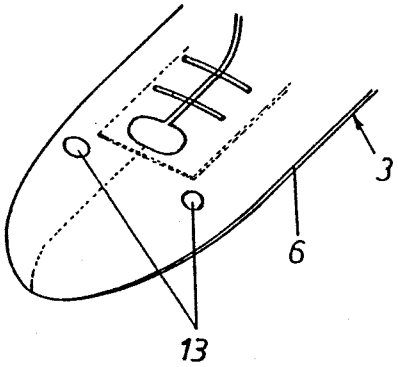
FIG. 2 shows an illustration of the inner shoe seen from an oblique front view.
Figure 1:
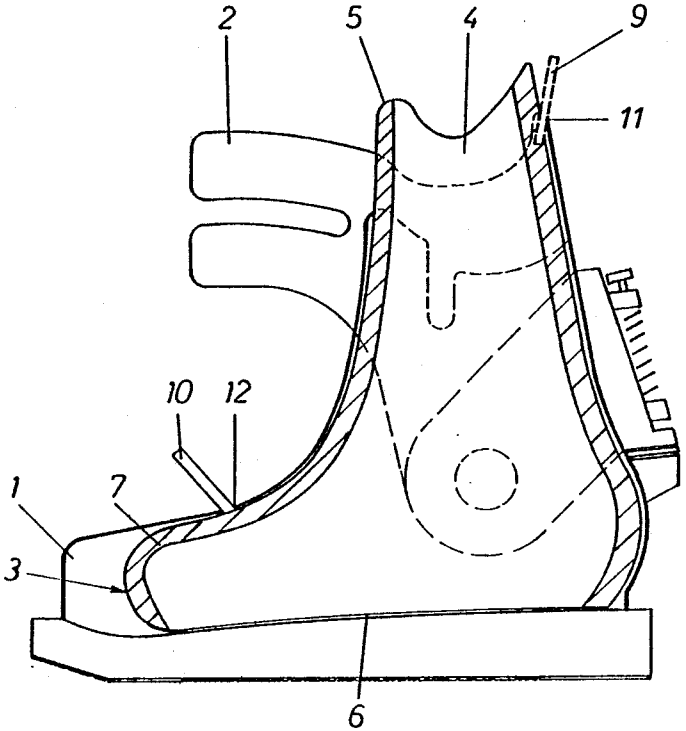
FIG. 1 shows a section through a skiing boot in the region of the longitudinal plane of symmetry.

In the drawing 1 denotes a skiing boot shell which is linked to a collar region 2 for protecting the ankle region of the foot of the skier. 3 represents the inner shoe composed of an inner lining 4, an outer lining 5 and a sole 25, the space between the inner and outer linings being filled by a foam material 7.

Filling the inner shoe 3 with foam is brought about in that firstly the inner lining and the outer lining in the form of a hollow sock are drawn over the feet of the skier who wears skiing socks. The hollow sock is sewn up along the entry opening, i.e. along the upper margin, and along the instep opening which is to be laced up or to be closed in another manner. The inner lining 4 is primarily formed from a relatively strong fabric on that side which faces the cavity which is sealed by a rubber layer whilst the outer lining is formed e.g. from thin leather, plastics material or the like. Close to the upper edge of the outer lining 5 an outlet apperture 8 is provided on each side of the longitudinal centre plane and in the region of the lower end of the inset opening one inlet apperture 13 each is provided on each of the two sides of the longitudinal centre plane. From each of the outlet appertures sna from each of the two inlet appertures one pipe 9 or 10 each passes in this working example by way of appropriate appertures through the shell 1 on the sleeve 2 to the outside. It stands to reason that with regard to the number and arrangement of the inlet and outlet appertures various modifications are possible. E.g. it is possible to provide only a single outlet apperture in the heel region in the longitudinal central plane.

Whilst the skier stands in both boots the foam bottle is connected by way of an adapter to the ends of the two tubes 10 whereafter foam introduction is proceded with until such time that foam emerges from the outlet tubes 9. At that stage the tubes 9,10 are jerked out and the inner shoe is removed from the outer boot. Hence the openings for the tubes 9,10 are appropriately closed by means of cover caps whereafter the inner shoe is inserted into the shell 1.

Figure 4:
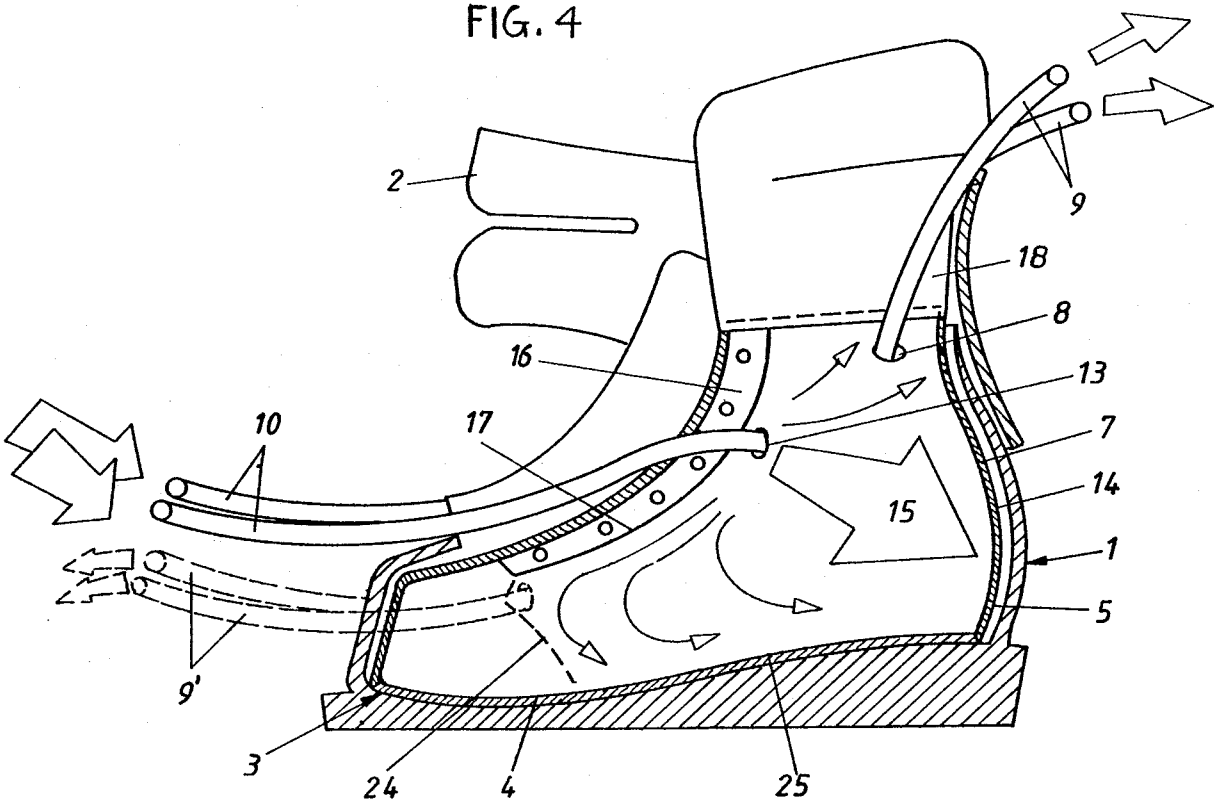

In conclusion it should be mentioned that the introduction of the foam or of the composition can take place in any optional position or positions of the front region of the boot. If only a single opening is provided this should be preferably positioned in the longitudinal central plane of the boot. Two appertures are preferably positioned symmetrically in respect of this plane. The introduction of the foam or composition may take place on the lowest part of the front region of the shoe or on both sides of the lower end of the opening of the shoe or its region. Preferably, the introduction of the foam or composition takes place, as shown in FIG. 4, in the flexor region of the shoe defined as the area between the instep and ankle portions.

The sock 14 is so designed that air can escape at least in the instep and partly also in the heel region, but not foam. This task is so attained in that the material of the sock 14 is air pervious but essentially foam impervious, e.g. being a fabric, or that the sock 14 is formed of air- and foam-impervious material, e.g. of leather or plastics and that at least in those positions where air is to escape, appropriate pores, fine appertures or the like are formed. In practice the hollow sock 14 can be manufactured from a plurality of punched-out blanks which are sewn together such that at least along the seams and/or through natural or artificially provided pores the air can escape. It stands to reason that the pores or the like need not necessarily be so designed that air only can escape; the possibility also exists that traces of the foam material may emerge through individual sewing stitches, pores or the like, however without impairing the quality of the inner shoe.

Advantageously a foam material on the basis of polyurethane is selected. In the event that a part of the skiing boots or at least the shell in the case of skiing boots comprising a shell and a shaft, are made of plastics on a poly-urethane basis, it is possible for a bond to be formed between the composition and the shell if such composition were to emerge on the shell side.

The composition is introduced in the flexor region of the foot by way of the tubes 10 on the left and right hand sides of the longitudinal plane, preferably simultaneously, the composition, as indicated by the large arrow 15, initially flowing towards the heel, whereafter it will spread towards the tip and partly also towards the ankle. In the course thereof, as the spreading of the composition procedes, the main portion of air escapes by way of the tubes 9 in the upper region of the sock 14 so that no dead cavities can form. The sock 14 may in the tip region be sewn closed on each side as illustrated by broken line 24 such that the composition cannot enter right into the foot tip area. In that case the tip region which is not filled with foam comprises on the inside of a soft, adhesively applied lining for purposes of cold protection. In this manner an improved freedom of movement of the toes is attained.

The sock 14 preferably comprises a left and a right hand blank portion; these blank portions are centrally sewn together in the tip and heel regions and form the outside of the sock. The inner wall of the sock is formed by the inner lining 4 which is sewn onto the two blanked components in order to form the hollow sock 14. In the instep region an eyelet strip 16 is formed by one seam 17 on each side. On the bottom side all blanks are sewn to a sole portion 25, e.g. of leather or plastics in order to avoid the composition flowing under the foot. The sewing seam 17 prevents the entry of the composition into the interior of the eyelet strip 16 but, like all other seams, permits the escape of air. At the lower end of the eyelet strip 16 or respectively at the start of the central seam position of the two blank portions at the tip of the sock a tongue (not illustrated) is sewn on. At the upper side of the sock 14 a sleeve-like supporting member 18 is fitted to the blanked portions, similarly by sewing. The interconnection of the two blanks in the heel region can also be provided by means of a strip of leather or plastic (not illustrated) which is sewn to the blanks.

Various further modifications and additional features can, of course, be provided within the scope of the invention. Thus, it is e.g. possible to provide at the toe end of the cavity a further duct 9' for discharging the displaced air from the cavity of the sock. This provides the possibility that a more accurate filling of the cavity at its front end can be determined accurately be virtue of the emergence of foam on the sides of the sock being an indication that this cavity portion has been filled completely.

The aforegoing description of specific embodiments is to be read with the more gneral description of the invention preceding it, from which alternatives are apparent to that which is specifically exemplified with reference to the drawings, and should also be read with the contents of the claims. A person skilled in the art will be able to apply these teachings to the full scope of the claims.

I claim:

1. Process for the cushioning of an inner shoe for skiing boots, said process comprising:

filling the inner shoe with foam material, while the foot of the wearer, clad with a double-walled, hallow sock having ankle, heel, instep and tip regions forming the inner shoe is located inside the ski boot, and introducing the foam material into the hollow sock in the flexor region of the hollow sock said region defined as being between the instep and ankle regions, wherein and the air displaced by the foam material being released at a top end of the hollow sock, and said introducing of the foam material into the hollow sock being introduced on both longitudinal sides of the hollow sock in the flexor region such that the flow of the foam material moves initially towards the heel of the hollow sock, whereafter the foam material spreads towards the tip of the hollow sock and partly also towards the ankle of the sock.

2. Process according to claim 1, wherein the foam material is introduced to the right and left side of the longitudinal plane of symmetry of the sock simultaneously.

3. Process according to claim 1, wherein the sock is made of air-impervious, and essentially foam-impervious material.

4. Process according to claim 1, wherein the sock is divided off by a seam in the tip such that the tip is free of foam material.

5. Process according to claim 1, wherein the tip of the sock includes at least one tube, each for the discharge of displaced air.

* * * * *